US010283054B2

(12) United States Patent
Park et al.

(10) Patent No.: US 10,283,054 B2
(45) Date of Patent: May 7, 2019

(54) PIXEL AND DISPLAY DEVICE HAVING THE SAME

(71) Applicant: SAMSUNG DISPLAY CO., LTD., Yongin-si, Gyeonggi-do (KR)

(72) Inventors: Jun-Hyun Park, Yongin-si (KR); An-Su Lee, Yongin-si (KR); Ji-Hye Lee, Yongin-si (KR); Bo-Yong Chung, Yongin-si (KR); Kang-Moon Jo, Yongin-si (KR); Chong-Chul Chai, Yongin-si (KR)

(73) Assignee: Samsung Display Co., Ltd., Yongin-Si, Gyeonggi-do (KR)

( * ) Notice: Subject to any disclaimer, the term of this patent is extended or adjusted under 35 U.S.C. 154(b) by 0 days.

(21) Appl. No.: 15/696,734

(22) Filed: Sep. 6, 2017

(65) Prior Publication Data

US 2018/0226029 A1 Aug. 9, 2018

(30) Foreign Application Priority Data

Feb. 6, 2017 (KR) ..... 10-2017-0016277

(51) Int. Cl.
*G09G 3/3266* (2016.01)
*G09G 3/3258* (2016.01)
*G09G 3/3291* (2016.01)

(52) U.S. Cl.
CPC ..... *G09G 3/3266* (2013.01); *G09G 3/3258* (2013.01); *G09G 3/3291* (2013.01); *G09G 2300/0842* (2013.01); *G09G 2310/0208* (2013.01); *G09G 2310/0213* (2013.01); *G09G 2310/0243* (2013.01); *G09G 2310/062* (2013.01); *G09G 2320/0233* (2013.01); *G09G 2330/028* (2013.01)

(58) Field of Classification Search
CPC ..... G09G 3/30; G09G 3/32; G09G 3/3208; G09G 3/3225–3/3258
See application file for complete search history.

(56) References Cited

U.S. PATENT DOCUMENTS

2006/0244695 A1* 11/2006 Komiya ..... G09G 3/006 345/76
2015/0379956 A1* 12/2015 Nonaka ..... G09G 3/3233 315/172
2016/0275869 A1 9/2016 Hwang et al.

* cited by examiner

*Primary Examiner* — David Tung
(74) *Attorney, Agent, or Firm* — Lee & Morse, P.C.

(57) ABSTRACT

A pixel includes first to fourth transistors and a driving transistor. The first transistor is connected between a data line and a first node and has a gate electrode to receive a scan signal. The driving transistor is connected between the first node and a second node and has a gate electrode connected to a third node. The second transistor is connected between the second and third nodes and has a gate electrode to receive the scan signal. The third transistor is connected between first power and the first node and has a gate electrode to receive an emission signal. The fourth transistor is connected between the first and second nodes and has a gate electrode to receive an initialization signal. An organic light emitting diode is connected between the second node and second power. A storage capacitor is connected between the first power and third node.

19 Claims, 13 Drawing Sheets

PIXEL AND DISPLAY DEVICE HAVING THE SAME

CROSS REFERENCE TO RELATED APPLICATION

Korean Patent Application No. 10-2017-0016277, filed on Feb. 6, 2017, and entitled: "Pixel and Display Device Having the Same," is incorporated by reference herein in its entirety.

BACKGROUND

1. Field

One or more embodiments herein relate to a pixel and display device.

2. Discussion of Related Art

A variety of methods have been proposed for controlling a display. Examples include a progressive emission method and a simultaneous emission method. In a progressive emission method, rows of pixels sequentially emit light. In a simultaneous emission method, all pixels in the display simultaneously emit light after a sequential data writing operation is completed.

One type of progressive emission display has pixels with a 7T-1C structure, e.g., 7 transistors and 1 capacitor. One type of simultaneous emission display has pixels with a 4T-1C structure (e.g., 4 transistors and 1 capacitor), where the transistors are p-channel metal oxide semiconductor (PMOS) transistors. The 4T-1C pixels in this display do not initialize the anode voltage of an organic light emitting diode. In these or other displays, first and second power applied as a pixel driving voltage change voltage levels based on data writing or emission states. Therefore, a time for initializing the anode voltage and a non-emission time increase and power supply stability is reduced. This may cause luminance deviation and image uniformity deterioration.

SUMMARY

In accordance with one or more embodiments, a display device includes a display panel including a plurality of pixels; and a display panel driver to drive a plurality of scan lines, a plurality of emission control lines, a plurality of initialization lines, and a plurality of data lines, the display panel driver to provide first power and second power to the display panel, wherein each of the pixels includes: a first transistor connected between one of the data lines and a first node and having a gate electrode to receive a scan signal; a driving transistor connected between the first node and a second node and having a gate electrode connected to a third node; a second transistor connected between the second node and the third node and having a gate electrode to receive the scan signal; a third transistor connected between the first power and the first node and having a gate electrode to receive an emission signal; a fourth transistor connected between the first node and the second node in parallel with the driving transistor and having a gate electrode to receive an initialization signal; an organic light emitting diode connected between the second node and the second power; and a storage capacitor connected between the first power and the third node.

The display panel driver may drive the display panel based on a frame which includes: an initialization period to simultaneously initialize a second node voltage and a third node voltage, a writing period after the initialization period to compensate a threshold voltage of the driving transistor and sequentially write data voltages, and an emission period after the writing period to cause the pixels to simultaneously emit light. The driving transistor may be a p-channel metal oxide semiconductor transistor, and the fourth transistor may be an n-channel metal oxide semiconductor transistor.

The first power may be a predetermined constant voltage, and the second power may have one of a first voltage level or a second voltage level greater than the first voltage level. Each of a turn-on level of the scan signal and a turn-on level of the emission signal may correspond to a logic low level, and a turn-on level of the initialization signal may correspond to a logic high level.

In the initialization period, the second power may have a first voltage level, the scan signal and the initialization signal may have a turn-off level, and the emission signal may have the turn-off level.

In the writing period, the second power may have the second voltage level, the initialization signal and the emission signal may have a turn-off level, and the scan signal ma have a turn-on level sequentially in order of pixel rows.

In the emission period, the second voltage may have the first voltage level, the emission signal may have a turn-on level, and the scan signal and the initialization signal may have a turn-off level. The first voltage level of the second power may be less than the first power, and the second voltage level of the second power may be greater than the first power.

The display panel driver may include a global gate driver to commonly provide the emission signal to the pixels through the emission lines and to commonly provide the initialization signal to the pixels through the initialization lines. The global gate driver may output the initialization signal having a turn-on level during the initialization period and may output the emission signal having a turn-on level during the emission period.

The display panel driver may include a scan driver to simultaneously output the scan signal having a turn-on level to the scan lines during the initialization period and to sequentially output the scan signal having the turn-on level to the scan lines in order of pixel rows. The power supply may provide a sustain voltage to the data lines, the sustain voltage may be provided to the display panel through the data line in the initialization period and the emission period, and an anode voltage of the organic light emitting diode and a gate voltage of the driving transistor may be initialized to the sustain voltage in the initialization period.

The first to fourth transistors and the driving transistor may be p-channel metal oxide semiconductor transistors, the first power may be a predetermined constant voltage and the second power may have one of a first voltage level and a second voltage level greater than the first voltage level.

The display panel driver may include a global gate driver to commonly provide the emission signal to the pixels through the emission lines. The initialization signal may correspond to a next scan signal of a current scan signal corresponding to a next pixel row with respect to a current pixel row.

In accordance with one or more other embodiments, a pixel includes a first transistor connected between one of the data lines and a first node and having a gate electrode to receive a K-th scan signal, where K is a positive integer; a driving transistor connected between the first node and a second node and having a gate electrode connected to a third node; a second transistor connected between the second node and the third node and having a gate electrode to receive the K-th scan signal; a third transistor connected between a first power and the first node and having a gate electrode to receive an emission signal; a fourth transistor connected between the first node and the second node in parallel with the driving transistor and having a gate electrode to receive an initialization signal; an organic light emitting diode connected between the second node and a second power; and a storage capacitor connected between the first power and the third node.

The driving transistor may be a p-channel metal oxide semiconductor transistor, and the fourth transistor may be an n-channel metal oxide semiconductor transistor. The fourth transistor may be one of an oxide thin film transistor, a low temperature poly-silicon (LTPS) thin film transistor, or a low temperature polycrystalline oxide (LTPO) thin film transistor. The first power may be a predetermined constant voltage, and the second power may have one of a first voltage level or a second voltage level greater than the first voltage level.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
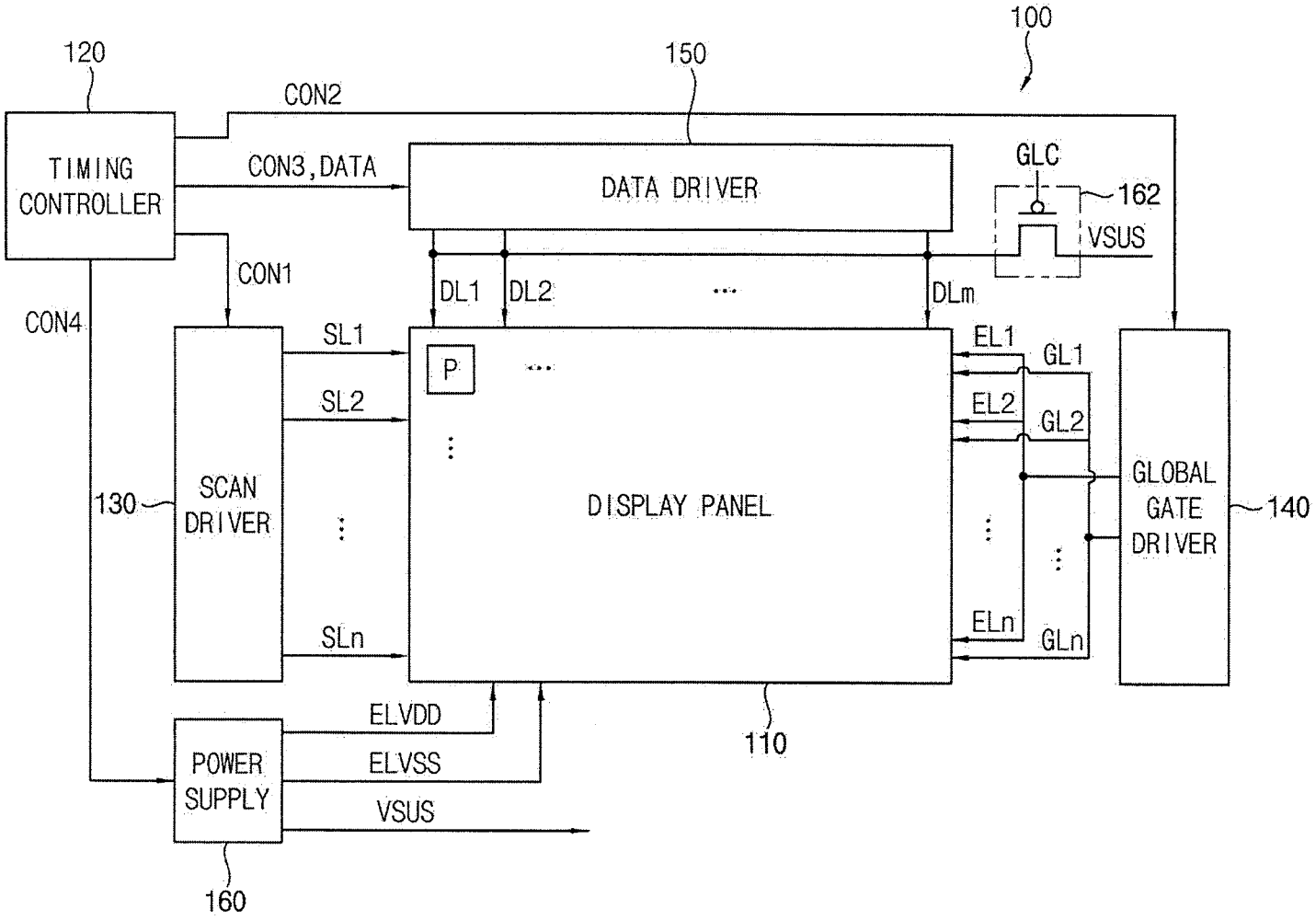
FIG. 1 illustrates an embodiment of a display device.

Example embodiments are described with reference to the drawings; however, they may be embodied in different forms and should not be construed as limited to the embodiments set forth herein. Rather, these embodiments are provided so that this disclosure will be thorough and complete, and will convey exemplary implementations to those skilled in the art. The embodiments (or portions thereof) may be combined to form additional embodiments In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of a display device 100 which includes a display panel 110 and a display panel driver. The display panel driver may include a timing controller 120, a scan driver 130, a global gate driver 140, a data driver 150, and a power supply 160. The display device 100 may display an image by a progressive scan and simultaneous emission method. The display device 100 may be, for example, an organic light emitting display device or another type of flat display device. The display device may be a flexible display device, a transparent display device, or a head mount display device.

The display panel 110 may include a plurality of scan lines SL1 to SLn, a plurality of initialization lines GL1 to GLn, a plurality of emission control lines EL1 to ELn, a plurality of data lines DL1 to DLm, and a plurality of pixels connected to the scan lines SL1 to SLn, the initialization lines GL1 to GLn, the emission control lines EL1 to ELn, and the data lines DL1 to DLm, where n and m are integers greater than 1.

Each of the pixels 10 may include a first transistor, a second transistor, a third transistor, fourth transistor, and a driving transistor. The first transistor is connected between one of the data lines DL1 to DLm and a first node, and includes a gate electrode to receive a K-th scan signal. The driving transistor is connected between the first node and a second node and has a gate electrode connected to a third node. The second transistor is connected between the second node and the third node and has a gate electrode to receive the K-th scan signal. The third transistor is connected between a first power ELVDD and the first node and has a gate electrode to receive an emission signal. The fourth transistor is connected between the first node and second node in parallel with the driving transistor, and has a gate electrode to receive an initialization signal. An organic light emitting diode is connected between the second node and a second power ELVSS. A storage capacitor is connected between the first power ELVDD and the third node, where K is a positive integer less than or equal to n.

In some embodiments, a frame period includes an initialization period, a writing period, and a light emission period. A gate voltage of the driving transistor and an anode voltage of the organic light emitting diode is substantially simultaneously initialized in the initialization period. Data voltages are sequentially written to pixel rows in the writing period after the initialization period. The pixels 10 simultaneously emit light in the light emission period after the writing period.

The display panel driver may drive the scan lines SL1 to SLn, the emission control lines EL1 to ELn, the initialization lines GL1 to GLn, and the data lines DL1 to DLm and provide the first power ELVDD and the second power ELVSS to the display panel 110. The display panel driver may include the timing controller 120, the scan driver 130, the global gate driver 140, the data driver 150, and the power supply 160.

The timing controller 120 may control the scan driver 130, the global gate driver 140, the data driver 150, and the power supply 160. The timing controller 120 may respectively provide first to fourth control signals CON1, CON2, CON3, and CON4 to the scan driver 130, the global gate driver 140, the data driver 150, and the power supply 160. In some embodiments, the timing controller may receive an RGB image signal, a vertical synchronization signal, a horizontal synchronization signal, a main clock signal, a data enable signal, etc., and generate image data DATA corresponding to the RGB image signal and the first to fourth control signals CON1, CON2, CON3, and CON4 based on these signals.

The scan driver 130 may provide the scan signal to the scan lines SL1 to SLn based on the first control signal CON1. In some embodiments, the scan driver 130 may simultaneously output the scan signal having a turn-on level to the scan lines SL1 to SLn. The turn-on level may be, for example, a voltage level of the scan signal to turn on the transistor to which the scan signal is applied. Accordingly, the gate voltage of the driving transistor and the anode voltage of the organic light emitting diode of all the pixels 10 may be initialized to a certain voltage level. In some embodiments, the scan driver 130 may sequentially provide the scan signal having the turn-on level to pixels rows respectively corresponding to the scan lines SL1 to SLn during the writing period.

The global gate driver 140 may provide the emission signal to the emission control lines EL1 to ELn and the initialization signal to the initialization lines GL1 to GLn based on the second control signal CON2. In some embodiments, each of the emission signal and the initialization signal may correspond to a global gate signal. For example, the emission signal may be commonly provided to all the pixels 10 in the display panel 110. The initialization signal may be also commonly provided to all the pixels 10 in the display panel 110.

In some embodiments, the global gate driver 140 may output the initialization signal having the turn-on level during the initialization period. The pixels 10 may simultaneously perform an initializing operation according to a logical level of the initialization signal.

In some embodiments, the global gate driver 140 may output the emission signal having the turn-on level during the emission period. The pixels simultaneously emit light according to a logical level of the emission signal. In some embodiments, the global gate driver 140 may be physically included in the scan driver 130.

The data driver 150 may generate the data signal (data voltage) based on the third control signal CON3 from the timing controller 120. The data driver 150 may provide the data signal to the pixels 10 through the data lines DL1 to DLm. Data signals may correspond to data voltages for an image in the writing period. Voltages provided to the data lines DL1 to DLm in periods, except for the writing period, may correspond to the sustain voltage VSUS.

The sustain voltage VSUS may be applied to the pixels 10 through the data lines DL1 to DLm when the data voltage is not provided to the data lines DL1 to DLm. The sustain voltage VSUS may be a voltage to initialize the gate voltage of the driving transistor and the anode voltage of the organic light emitting diode. In some embodiments, the sustain voltage VSUS may be determined to be sufficiently less than a threshold voltage of the organic light emitting diode. In some embodiments, the sustain voltage VSUS may be provided from the power supply 160.

The power supply 160 may provide the first power ELVDD and the second power ELVSS to the display panel 110. The first power ELVDD may be a predetermined constant voltage. For example, the first power ELVDD may have a direct current (DC) voltage. The second power ELVSS may swing between a first voltage level and a second voltage level greater than the first voltage level. In some embodiments, the second power ELVSS may have the first voltage level in the initialization period and the emission period and the second voltage level in the writing period when the driving transistor is PMOS transistor. Since the second power ELVSS has the second voltage level in the writing period, current leakage by the data writing or unintended emission of the organic light emitting diode based on a rise of the anode voltage may be prevented.

The second voltage level of the second power ELVSS may be, for example, a value greater than the anode voltage when a maximum value of the data voltage is applied to the driving transistor. In one embodiment, the second voltage level of the second power ELVSS may be a value greater than or equal to a voltage level of the first power ELVDD. In one embodiment, the second voltage level of the second power ELVSS may be a level that does not cause the organic light emitting diode to emit light during the writing period.

In some embodiments, the power supply 160 may further provide the sustain voltage VSUS to the data lines DL1 to DLm. In some embodiments, the display device 100 may further include a switch transistor 162 connected between the data lines DL1 to DLm and the power supply 160. The switch transistor 162 may have a gate electrode to receive a data line control signal GLC. In some embodiments, the data line control signal GLC may be provided from the timing controller 120. The sustain voltage VSUS may be generated and provided from other elements than the power supply 160. In one embodiment, the switch transistor 162 may be outside the display panel 110.

As described above, the display device 100 of the simultaneous driving method according to example embodiments may simultaneously initialize the gate voltage of the driving transistor and the anode voltage of the organic light emitting diode of each of the pixels 10 during the initialization period. As a result, initialization time may be reduced. Also, initialization deviation of the pixels 10 and initialization deviation between the gate voltage and the anode voltage may be eliminated. In addition, the transistor for initialization may be an NMOS transistor (e.g., an oxide thin film transistor, NMOS LTPS thin film transistor, etc.) having high response speed. This may allow for a further reduction in initialization time. Thus, display failure due to initialization deviation may be reduced. In addition, the first power ELVDD may be a constant voltage and the second power ELVSS may have only two voltage levels. As a result, images may be stably displayed without blur and/or flicker.

Figure 2:
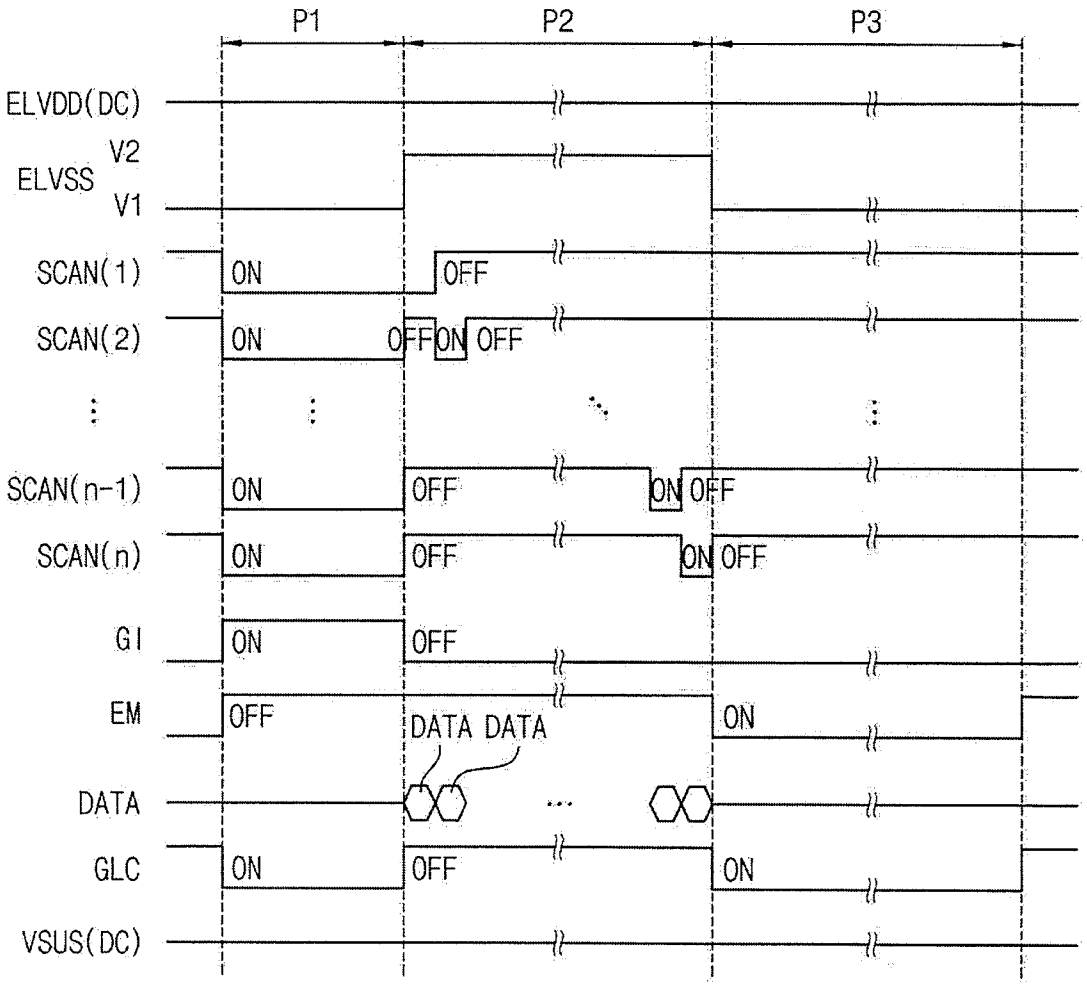
FIG. 2 illustrates an embodiment of signals for controlling the display device.

FIG. 2 illustrates an embodiment of a timing diagram for controlling operation of the display device of FIG. 1. Referring to FIGS. 1 and 2, a single frame period of the display device 100 may include an initialization period P1, a writing period P2, and an emission period P3. In some embodiments, a first power ELVDD may be a predetermined constant voltage. A second power ELVSS may have one of a first voltage level V1 or a second voltage level V2 greater than the first voltage level V1. For example, the second power ELVSS may have the first voltage level V1 in the initialization period P1 and the emission period P3 and may have the second voltage level V2 in the writing period P2.

In some embodiments, each of the emission signal EM and the initialization signal may be a global signal commonly provided to all the pixels 10.

In the initialization period P1, scan signals SCAN(1) to SCAN(n) and the initialization signal GI may have a turn-on level and the emission signal EM may have a turn-off level.

In some embodiments, the scan driver 130 may simultaneously output the scan signals SCAN(1) to SCAN(n). Each of the scan signals SCAN(1) to SCAN(n) may have a turn-on level during the initialization period P1. The global gate driver 140 may output the initialization signal GI having the turn-on level and the emission signal EM having the turn-off level during the initialization period P1. Accordingly, the gate voltage of the driving transistor and the anode voltage of the organic light emitting diode of each pixel 10 may be substantially simultaneously initialized to the same voltage.

In some embodiments, a transistor receiving the initialization signal GI may be an NMOS transistor and the driving transistor may be a PMOS transistor. Thus, as illustrated in FIG. 2, the turn-on level of the initialization signal GI may be a logic high level and the turn-off level of the initialization signal GI may be a logic low level. In contrast, the turn-on level of the scan signals SCAN(1) to SCAN(n) and emission signal EM may be the logic low level and the turn-off level of the scan signals SCAN(1) to SCAN(n) and emission signal EM may be the logic high level. Thus, the turn-on level of the initialization signal GI may be different from that of the scan and emission signals.

In some embodiments, switch transistor 162 outside the display panel 110 may be turned on by the data line control signal GLC, to provide the sustain voltage VSUS to the pixels 10 through the data lines DL1 to DLm. The gate voltage of the driving transistor and the anode voltage of the organic light emitting diode may be initialized to the sustain voltage VSUS.

In the writing period, the second power ELVSS may have the second voltage level V2, the initialization signal GI and emission signal may have the turn-off level, and the scan signals SCAN(1) to SCAN(n) may sequentially have the turn-on level in order of the pixel rows. The scan driver 130 may sequentially output the scan signals SCAN(1) to SCAN (n), each having the turn-on level in order of the pixel rows during the writing period P2. The global gate driver 140 may output the initialization signal GI and the emission signal EM, each having the turn-off level during the writing period P2. Accordingly, data voltages DATA may be sequentially written on the pixel rows. A drain electrode and the gate electrode of the driving transistor of each of the pixels 10 may be shorted (e.g., diode-connected). Thus, threshold voltage compensation of the driving transistor may be performed simultaneously with the data writing.

In some embodiments, the second voltage level of the second power ELVSS may be greater than the anode voltage when a maximum value of the data voltage is applied to the driving transistor. For example, when the driving transistor is the PMOS transistor, the second voltage level V2 may be based on a data voltage corresponding to a black image or the lowest grayscale level.

Since the data line control signal GLC may have the turn-off level during the writing period P2, the switch transistor 162 may be turned off and the data voltages DATA may be provided to the pixels 10 through the data lines DL1 to DLm.

In the emission period P3, the second power ELVSS may have the first voltage level V1, the emission signal EM may have the turn-on level, and the scan signals SCAN(1) to SCAN(n) and the initialization signal GI may have the turn-off level. Accordingly, all pixels 10 may simultaneously emit light based on respective data voltages DATA.

Figure 3:
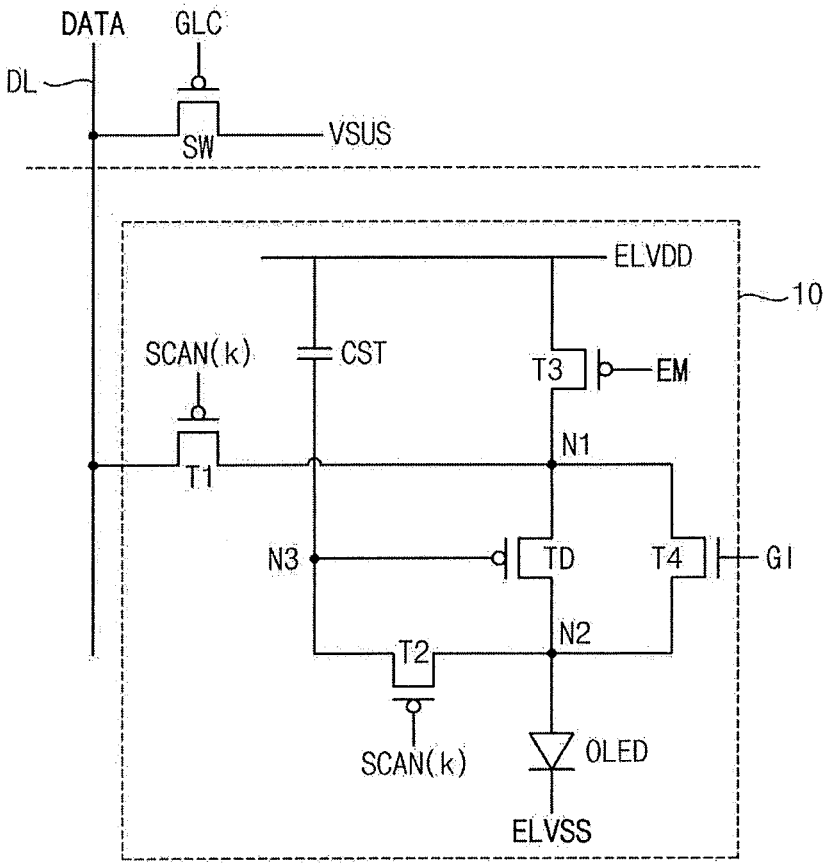
FIG. 3 illustrates an embodiment of a pixel.
Figure 4:
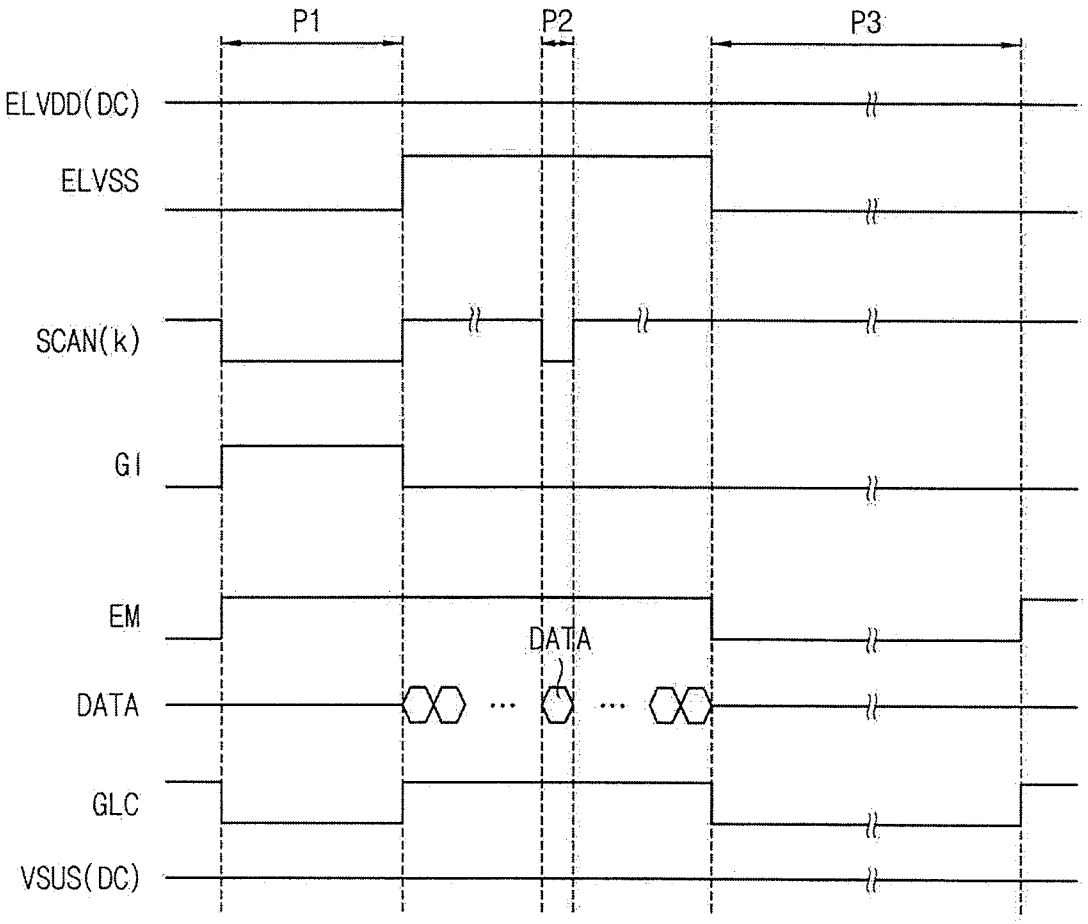
FIG. 4 illustrates an embodiment of signals for controlling the pixel.

FIG. 3 illustrates an embodiment of a pixel 10 which may be representative of the pixels in the display device 100, and FIG. 4 is a timing diagram illustrating an example operation of the pixel 10.

Referring to FIGS. 3 and 4, the pixel 10 may include a first transistor T1, a second transistor T2, a third transistor T3, a fourth transistor T4, a driving transistor TD, an organic light emitting diode OLED, and a storage capacitor CST. In some embodiments, the pixel 10 may be in a display device driven by a simultaneous emission method.

The first transistor T1 may be connected between a data line DL and a first node N1, and may include a gate electrode to receive a scan signal SCAN(k). The first transistor T1 may be turned on by a turn-on level of the scan signal SCAN(k), to transmit a voltage from the data line DL to the first node N1.

The driving transistor TD may be connected between the first node N1 and a second node N2, and may include a gate electrode connected to a third node N3. In some embodiments, the driving transistor TD may be a PMOS transistor. Thus, the first node N1 may correspond to a source electrode of the driving transistor TD, the second node N2 may correspond to a drain electrode of the driving transistor TD, and the third node N3 may correspond to the gate electrode of the driving transistor TD.

The second transistor T2 may be connected between the second node N2 and the third node N3, and may include a gate electrode to receive the scan signal SCAN(k). When the second transistor T2 is turned on, the gate electrode of the driving transistor TD and the drain electrode of the driving transistor TD may be shorted (e.g., diode connected) in order to perform threshold voltage compensation.

The third transistor T3 may be connected between the first power ELVDD and the first node N1. The third transistor T3 may include a gate electrode to receive the emission signal EM. The third transistor T3 may be turned on to transmit the first power ELVDD to the first node in the emission period P3.

The fourth transistor T4 may be connected between the first node N1 and the second node N2 in parallel with the driving transistor TD. The fourth transistor T4 may include a gate electrode to receive the initialization signal GI. The transistor type of the fourth transistor T4 may be different from the driving transistor TD. In some embodiments, the fourth transistor T4 may be an NMOS transistor. In some embodiments, the NMOS transistor may be implemented as an oxide thin film transistor. In some embodiments, the NMOS transistor may be implemented as a low temperature poly-silicon (LTPS) thin film transistor. In some embodiments, the NMOS transistor may be implemented as a low temperature polycrystalline oxide (LTPO) thin film transistor. Accordingly, the fourth transistor T4 may have relatively fast response speed and less leakage than the driving transistor TD.

The storage capacitor CST may be connected between the first power ELVDD and the third node N3. The organic light emitting diode OLED may be connected between the second node N2 and the second power ELVSS.

In some embodiments, the first to third transistors T1, T2, and T3 and the driving transistors TD may be PMOS transistors and only the fourth transistor T4 may be an NMOS transistor. Thus, the turn-on level of the initialization signal GI may be a logic high level.

Referring to FIG. 4, in the initialization period P1, the second power ELVSS may have the first voltage level V1, the scan signal SCAN(k) and the initialization signal GI may have a turn-on level, and the emission signal EM may have a turn-off level. Further, a switch SW outside the display panel may be turned on and a sustain voltage VSUS may be transmitted to the data line DL during the initialization period P1. Accordingly, the first, second, and fourth transistors T1, T2, and T4 may be turned on and the first, second, and third nodes N1, N2, and N3 may be shorted. Thus, the sustain voltage VSUS may be applied to the first, second, and third nodes N1, N2, and N3. The second node N2 may correspond to an anode of the organic light emitting diode and the third node N3 may correspond to the gate electrode of the driving transistor TD. Thus, an anode voltage and a gate voltage of the driving transistor TD may be simultaneously initialized to the sustain voltage VSUS in the initialization period P1.

In the writing period P2, the second power ELVSS may have the second voltage level, the initialization signal GI and the emission signal EM may have the turn-off levels, and the scan signal SCAN(k) may have the turn-on level. The data voltage DATA may be transmitted to the pixel 10 through the data line DL and the first and second transistors T1 and T2 may be turned on in the writing period P2. The drain and gate electrodes of the driving transistor TD may be shorted, so that a voltage corresponding to difference between the data voltage DATA and the threshold voltage of the driving transistor TD may be applied to the gate electrode. Thus, the threshold voltage compensation between the gate and source electrodes may occur with data writing in the writing period P2.

Since the second power ELVSS may have the second voltage level in the writing period P2, current leakage at the driving transistor TD by data writing and/or an unintended emission of the organic light emitting diode based on a rise of the anode voltage (e.g., a second node voltage) may be prevented.

In the emission period P3, the second power ELVSS may have the first voltage level again, the emission signal EM may have the turn-on level, and the scan signal SCAN(k) and the initialization signal GI may have the turn-off level. Accordingly, the third transistor T3 may be turned on and the driving transistor TD may generate emission current based on the data voltage DATA to emit light from the organic light emitting diode OLED.

In some embodiments, the second transistor T2 may also be an NMOS transistor (e.g., implemented as the oxide thin film transistor). Also, a signal applied to the gate electrode of the second transistor T2 may have a waveform opposite to the scan signal SCAN(k).

As described above, the pixel 10 may substantially simultaneously initialize the anode voltage of the organic light emitting diode OLED and the gate voltage of the driving transistor TD using the fourth transistor T4, which is connected in parallel with the PMOS-type driving transistor TD. Accordingly, the initialization time in every frame may be reduced. Thus, initialization deviation of the pixels 10 may be reduced or eliminated and display failure due to initialization deviation may be reduced. In addition, the fourth transistor T4 may be an NMOS transistor having a high response speed, and thus the initialization time may be further shortened.

Figure 5:
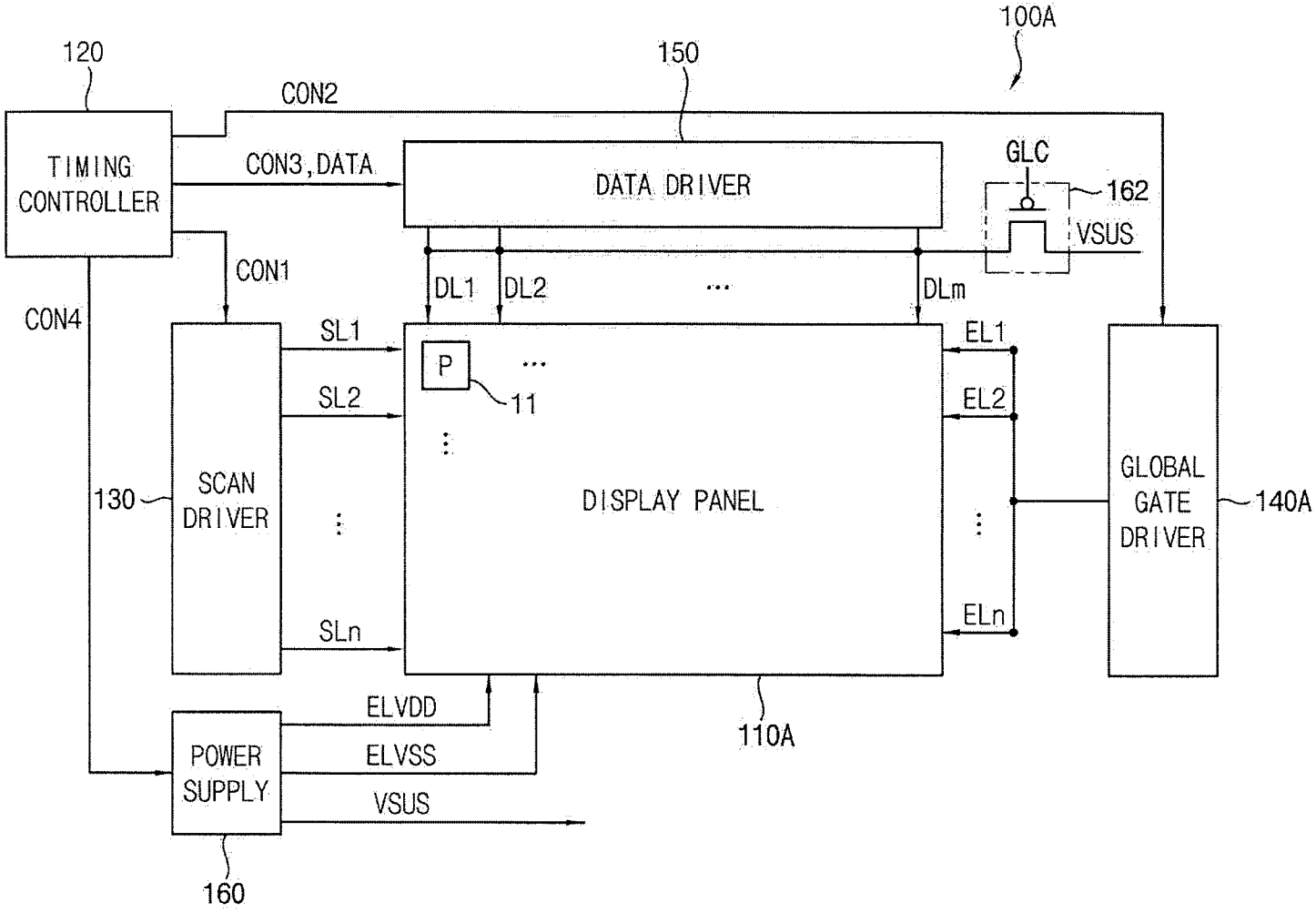
FIG. 5 illustrates another embodiment of a display device.
Figure 6:
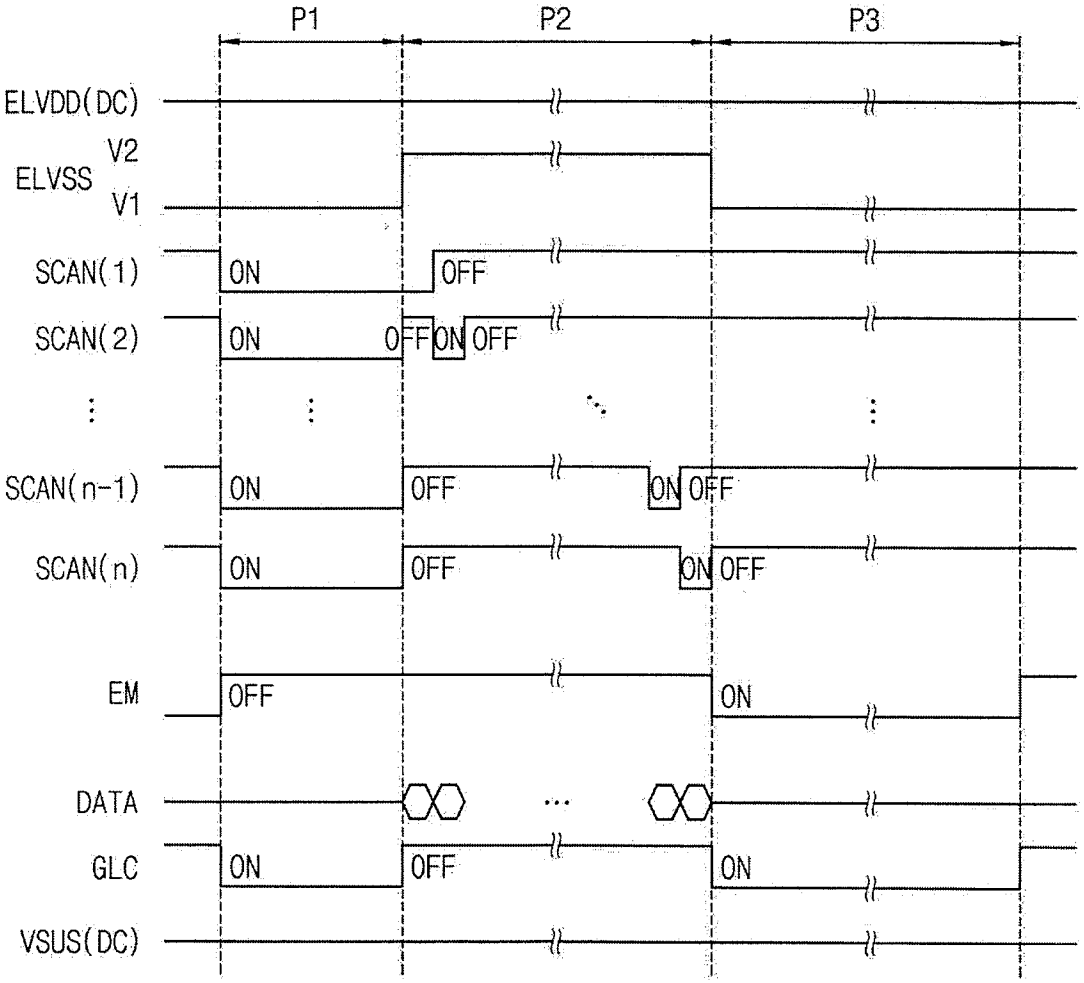
FIG. 6 illustrates an embodiment of signals for controlling the display device of FIG. 5.

FIG. 5 illustrates another embodiment of a display device 100A. FIG. 6 is a timing diagram illustrating an example operation of the display device 100A. The display device 100A may be substantially the same as or similar to the display device 100 in FIG. 1, except for the pixel and the global gate driver.

Referring to FIGS. 5 and 6, the display device 100A may include a display panel 110 and a display panel driver. The display panel driver may include a timing controller 120, a scan driver 130, a global gate driver 140A, a data driver 150, and a power supply 160. The display device 100 may display an image by progressive scan and simultaneous emission methods.

The display panel may include a plurality of pixels 11. Each pixel 11 may have substantially the same construction as pixel 10 in FIG. 3, except for the fourth transistor.

In some embodiments, a frame period includes an initialization period to substantially simultaneously initialize a gate voltage of the driving transistor and an anode voltage of the organic light emitting diode, a writing period after the initialization period to sequentially write data voltages to pixel rows, and an emission period after the writing period to control the pixels 11 to simultaneously emit light.

The timing controller 120 may control the scan driver 130, the global gate driver 140A, the data driver 150, and the power supply 160. The scan driver 130 may provide a scan signal to a plurality of scan lines SL1 to SLn based on a first control signal CON1. The global gate driver 140A may provide an emission signal to the emission control lines EL1 to ELn based on a second control signal CON2. The data driver 150 may generate a data signal (data voltage) based on a third control signal CON3 from the timing controller 120. The data driver 150 may provide the data signal to the pixels 11 through the data lines DL1 to DLm.

A sustain voltage VSUS may be applied to the pixels 11 through the data lines DL1 to DLm when the data voltage is not provided to the data lines DL1 to DLm. The sustain voltage VSUS may be a voltage to initialize a gate voltage of the driving transistor and an anode voltage of the organic light emitting diode.

The power supply 160 may provide the first power ELVDD and the second power ELVSS to the display panel 110. The first power ELVDD may be a predetermined constant voltage. For example, the first power ELVDD may have a direct current (DC) voltage. The second power ELVSS may swing between a first voltage level and a second voltage level greater than the first voltage level.

As illustrated in FIG. 6, the display device 100A may operate in an order of the initialization period P1, the writing period P2, and the emission period P3. Unlike the display device 100 in FIG. 1, the global gate driver 140A does not generate an initialization signal.

In the initialization period P1, the second power ELVSS may have the first voltage level V1, the scan signals SCAN (1) to SCAN(n) may have a turn-on level, and the emission signal EM may have a turn-off level. Accordingly, the gate voltage of the driving transistor and the anode voltage of the organic light emitting diode of each of the pixels 10 may be substantially simultaneously initialized to the same voltage.

In the writing period P2, the second power ELVSS may have the second voltage level V2, the emission signal EM may have the turn-off level, and the scan signals SCAN(1) to SCAN(n) may sequentially have the turn-on level in order of the pixel rows. Accordingly, the data voltages DATA may be sequentially written on the pixel rows.

In the emission period P3, the second power ELVSS may have the first voltage level V1, the emission signal EM may have the turn-on level, and the scan signals SCAN(1) to SCAN(n) may have the turn-off level. Accordingly, all the pixels 11 may simultaneously emit light corresponding to the respective data voltages DATA.

Figure 7:
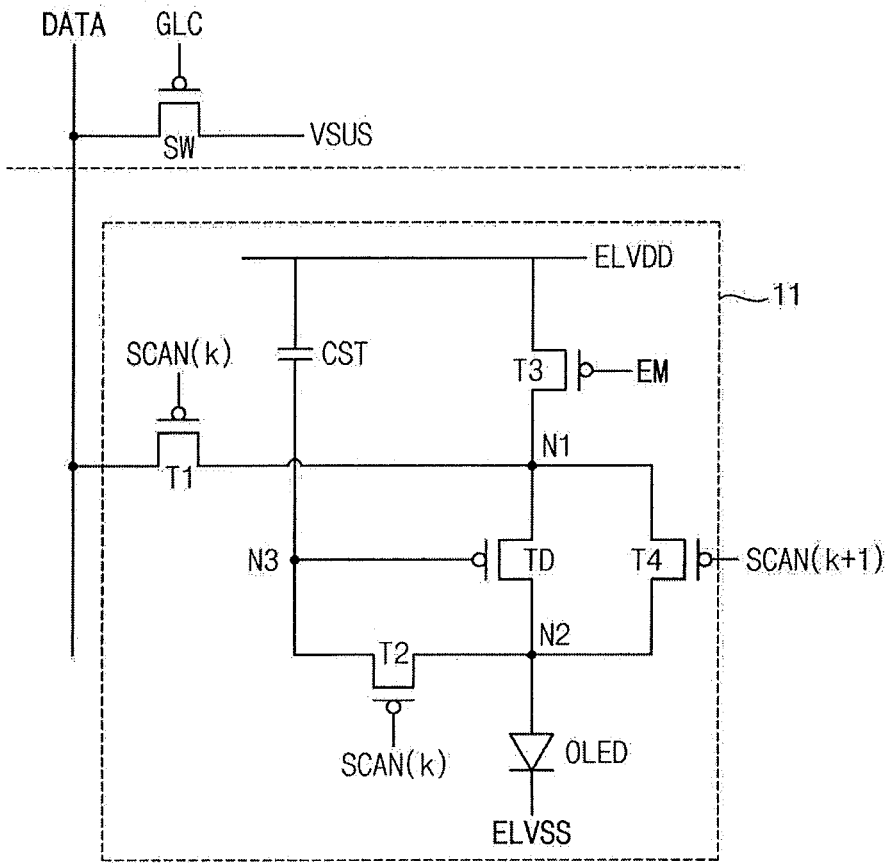
FIG. 7 illustrates another embodiment of a pixel.
Figure 8:
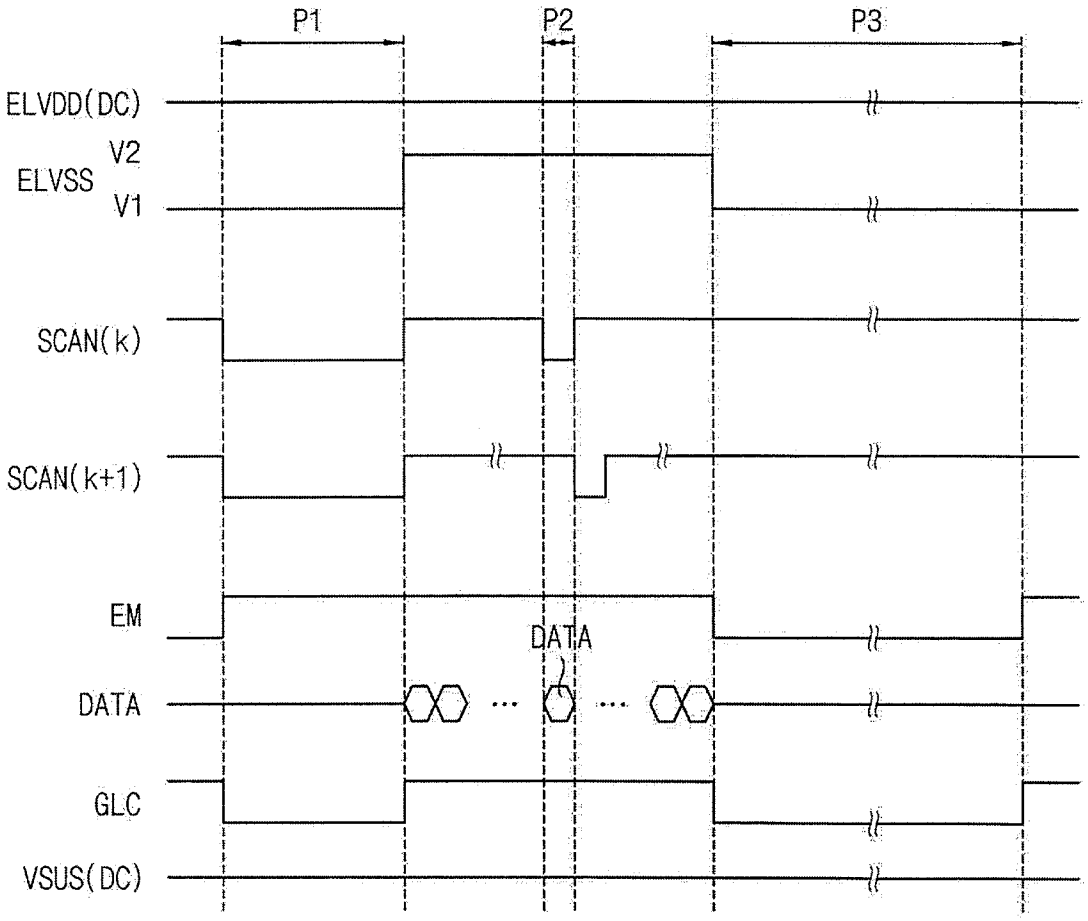
FIG. 8 illustrates an embodiment of signals for controlling the pixel of FIG. 7.

FIG. 7 illustrates another embodiment of a pixel 11 which may be representative of the pixels in the display device 100A. FIG. 8 is a timing diagram illustrating an example operation of the pixel 11. The pixel 11 may be substantially the same as or similar to the pixel 10 in FIG. 3, except for the fourth transistor.

Referring to FIGS. 7 and 8, the pixel 11 in a K-th pixel row may include a first transistor T1, a second transistor T2, a third transistor T3, a fourth transistor T4, a driving transistor TD, an organic light emitting diode OLED, and a storage capacitor CST, where K is a positive integer.

The first transistor T1 may be connected between a data line DL and a first node N1, and may include a gate electrode to receive a K-th scan signal SCAN(k). The driving transistor TD may be connected between the first node N1 and a second node N2. The driving transistor TD may include a gate electrode connected to a third node N3. The second transistor T2 may be connected between the second node N2 and the third node N3. The second transistor T2 may include a gate electrode to receive the K-th scan signal SCAN(k). The third transistor T3 may be connected between the first power ELVDD and the first node N1. The third transistor T3 may include a gate electrode to receive an emission signal EM. The fourth transistor T4 may be connected between the first node N1 and the second node N2 in parallel with the driving transistor TD. The fourth transistor T4 may include a gate electrode to receive a (K+1)-th scan signal SCAN(k+1) that is applied to a next pixel row (e.g., a (K+1)-th pixel row.

The storage capacitor CST may be connected between the first power ELVDD and the third node N3. The organic light emitting diode OLED may be connected between the second node N2 and the second power ELVSS.

In some embodiments, the first to fourth transistors T1, T2, T3, and T4 and the driving transistors TD may be PMOS transistors. Thus, a (K+1)-th scan line may be connected to the gate electrode of the fourth transistor T4.

As illustrated in FIG. 6, in the initialization period P1, the second power ELVSS may have the first voltage level V1, the K-th scan signal SCAN(k) and the (K+1)-th scan signal SCAN(K+1) may have a turn-on level and the emission signal EM may have a turn-off level. Thus, the first, second, and fourth transistors T1, T2, and T4 may be turned on, the first, second, and third nodes N1, N2, and N3 may be shorted, and an anode voltage and a gate voltage of the driving transistor TD may be simultaneously initialized to the sustain voltage VSUS in the initialization period P1.

In the writing period P2 of the K-th pixel row, the second power ELVSS may have the second voltage level, the emission signal EM may have the turn-off levels, and the K-th scan signal SCAN(k) may have the turn-on level. The data voltage DATA may be transmitted to the pixel 11 through the data line DL and first and second transistors T1 and T2 may be turned on in the writing period P2. The drain and gate electrodes of the driving transistor TD may be shorted to allow a voltage corresponding to difference between the data voltage DATA and the threshold voltage of the driving transistor TD to be applied to the gate electrode. Thus, the threshold voltage compensation between the gate and source electrodes may occur with data writing in the writing period P2.

In the emission period P3, the second power ELVSS may have the first voltage level again, the emission signal EM may have the turn-on level, the K-th scan signal SCAN(k) and (K+1)-th scan signal SCAN(K+1) may have the turn-off level. Thus, the third transistor T3 may be turned on and the driving transistor TD may generate emission current based on the data voltage DATA to emit light from the organic light emitting diode OLED.

As described above, the pixel 11 may substantially simultaneously initialize the anode voltage of the organic light emitting diode OLED and the gate voltage of the driving transistor TD using the fourth transistor T4, which connected in parallel with the PMOS-type driving transistor TD. Accordingly, initialization time in every frame may be reduced. Also, initialization deviation of the pixels 11 may be eliminated and display failure due to initialization deviation may be reduced.

Figure 9:
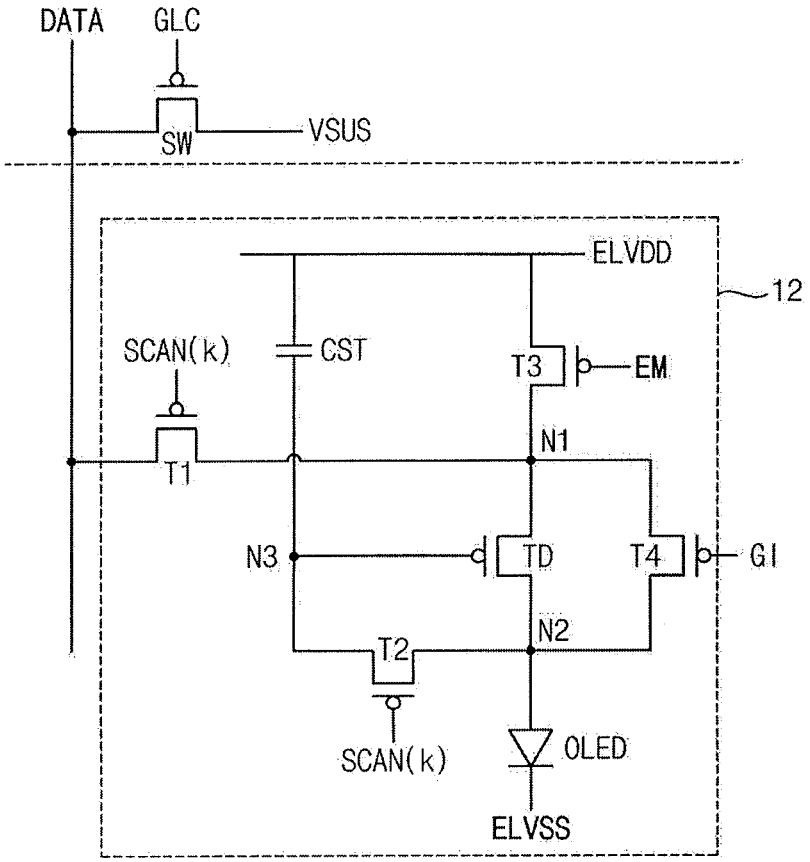
FIG. 9 illustrates another embodiment of a pixel.
Figure 10:
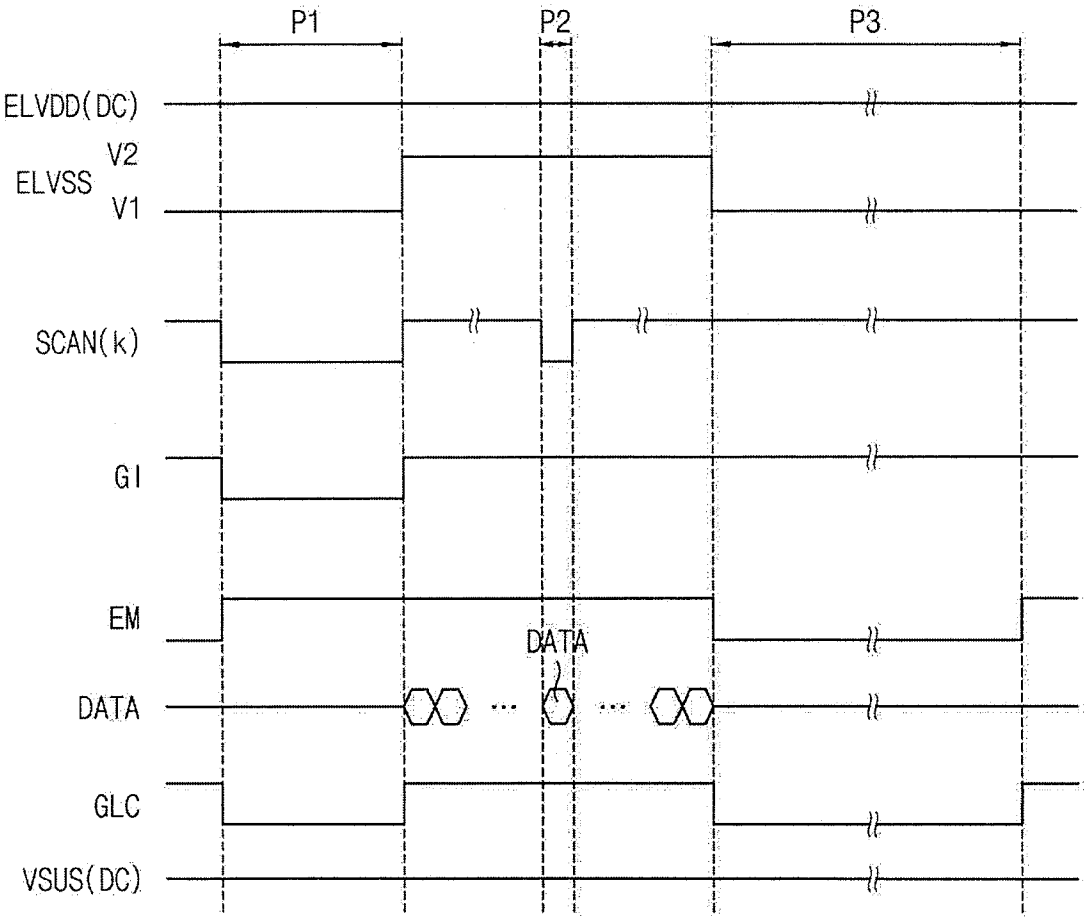
FIG. 10 illustrates an embodiment of signals for controlling the pixel of FIG. 9.

FIG. 9 illustrates another embodiment of a pixel 12, and FIG. 10 is a timing diagram illustrating an example operation of pixel 12 in FIG. 9. The pixel 12 may be substantially the same as or similar to the pixel 11 in FIG. 7, except for a signal applied to the fourth transistor.

Referring to FIGS. 9 and 10, the pixel 12 in a K-th pixel row may include a first transistor T1, a second transistor T2, a third transistor T3, a fourth transistor T4, a driving transistor TD, an organic light emitting diode OLED, and a storage capacitor CST, where K is a positive integer. In some embodiments, the first to fourth transistors T1, T2, T3, and T4 and the driving transistors TD may be PMOS transistors. An initialization signal GI as a global gate signal may be applied to the fourth transistor T4.

As illustrated in FIG. 10, the initialization signal GI may have a turn-on level in an initialization period P1 and a turn-off level in writing and emission periods P2 and P3. Thus, the fourth transistor T4 may be turned on only in the initialization period P1, so that an anode voltage and a gate voltage of the driving transistor TD may be simultaneously initialized to a sustain voltage VSUS.

As described above, the pixel 12 may substantially simultaneously initialize the anode voltage of the organic light emitting diode OLED and the gate voltage of the driving transistor TD using the fourth transistor T4 connected in parallel with the PMOS type driving transistor TD. Thus, initialization time in every frame may be reduced.

Figure 11:
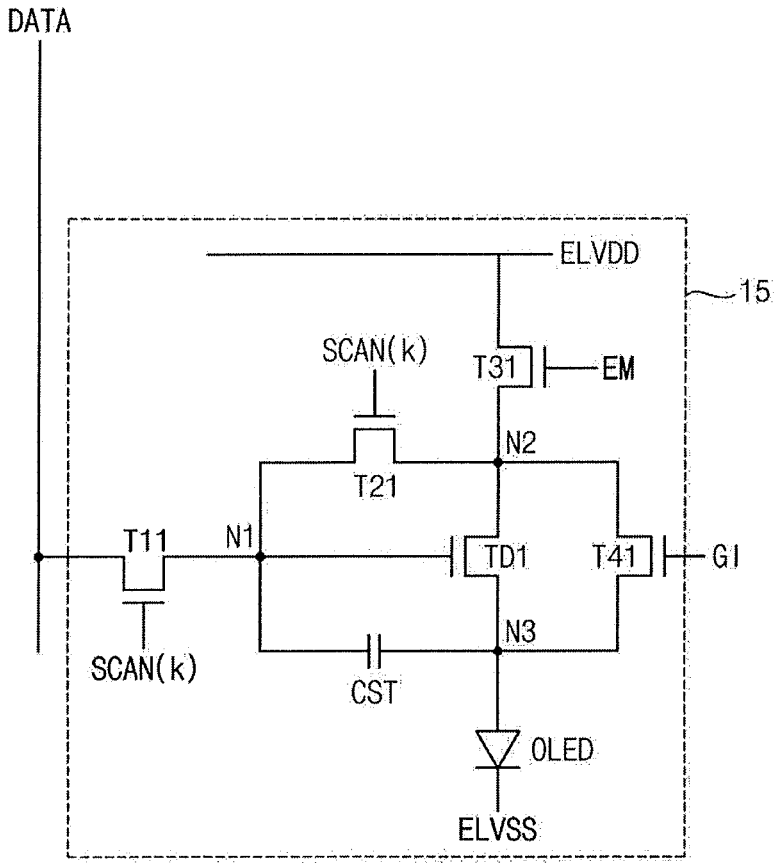
FIG. 11 illustrates another embodiment of a pixel.
Figure 12:
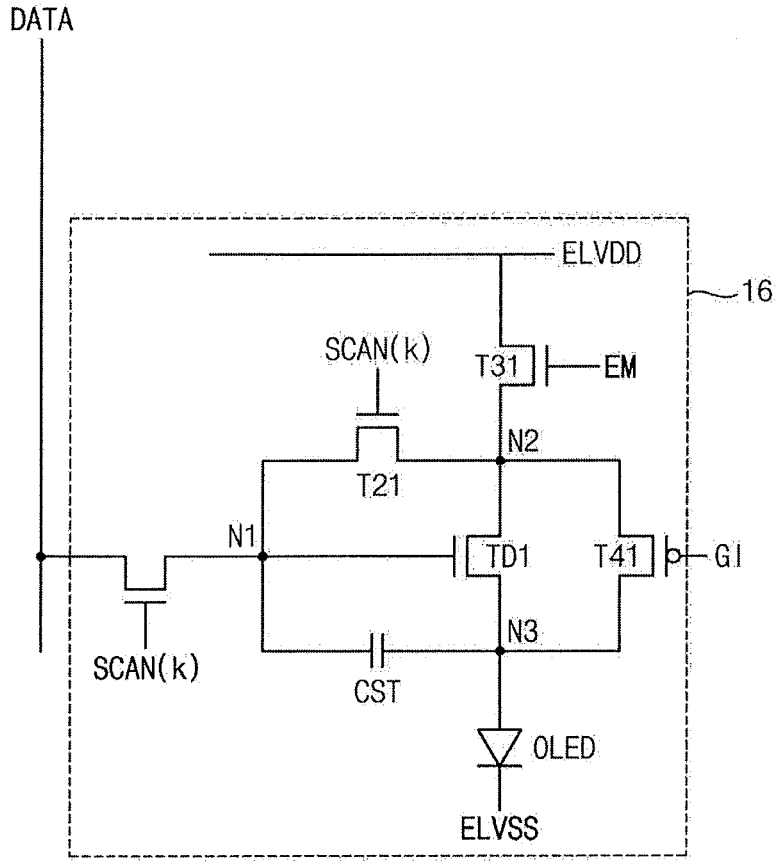
FIG. 12 illustrates another embodiment of a pixel.

FIG. 11 illustrates another embodiment of a pixel 15, and FIG. 12 illustrates another embodiment of a pixel 16. The pixels in FIGS. 11 and 12 may be substantially the same as or similar to the pixel in FIG. 3, except for the driving transistor that is implemented as an NMOS transistor.

Referring to FIGS. 11 and 12, each of the pixels 15 and 16 in a K-th pixel row may include a first transistor T11, a second transistor T21, a third transistor T31, a fourth transistor T41, a driving transistor TD1, an organic light emitting diode OLED, and a storage capacitor CST, where K is a positive integer. In some embodiments, the driving transistor TD1 may be an NMOS transistor. For example, the driving transistor TD1 may be implemented as an oxide thin film transistor, an LIPS thin film transistor, or an LTPO thin film transistor.

In some embodiments, as illustrated in FIG. 11, the first to fourth transistors T11, T21, T31, T41 may be NMOS transistors. In some embodiments, as illustrated in FIG. 12, the fourth transistor T41 may be a PMOS transistor.

The first transistor T11 may be connected between a data line DL and a first node N1, and may include a gate electrode to receive a K-th scan signal SCAN(k). The driving transistor TD may be connected between the first node N1 and a second node N2. The driving transistor TD may include a gate electrode connected to a third node N3. The second transistor T21 may be connected between the second node N2 and the third node N3. The second transistor T21 may include a gate electrode to receive the K-th scan signal SCAN(k). The third transistor T31 may be connected between the first power ELVDD and the first node N1. The third transistor T31 may include a gate electrode to receive an emission signal EM. The fourth transistor T41 may be connected between the first node N1 and the second node N2 in parallel with the driving transistor TD. The fourth transistor T4 may include a gate electrode to receive an initialization signal GI. The storage capacitor CST may be connected between the first power ELVDD and the third node N3. The organic light emitting diode OLED may be connected between the second node N2 and the second power ELVSS.

The gate voltage of the driving transistor TD1 and the anode voltage of the organic light emitting diode OLED may be substantially simultaneously initialized to the same voltage.

Figure 13:
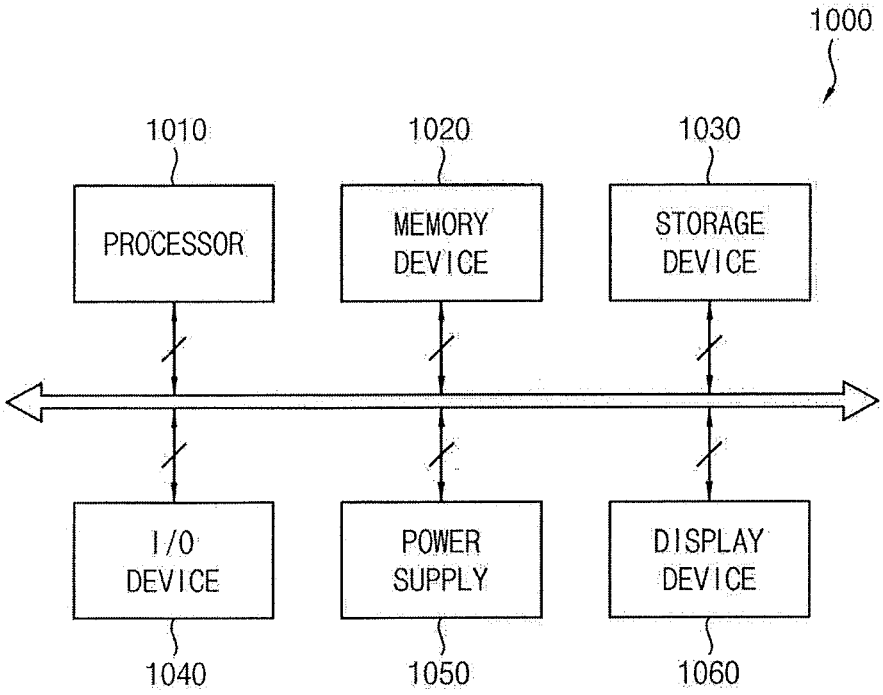
FIG. 13 illustrates an embodiment of an electronic device.

FIG. 13 illustrates an embodiment of an electronic device 1000 which may include a processor 1010, a memory device 1020, a storage device 1030, an input/output (I/O) device 1040, and a power supply 1050, and a display device 1060. The display device 1060 may correspond, for example, to any of the aforementioned embodiments.

In addition, the electronic device 1000 may include a plurality of ports for communicating with a video card, a sound card, a memory card, a universal serial bus (USB) device, other suitable electronic devices, etc. In one embodiment, the electronic device 1000 may be a head mount display (HMD), a television, a smart phone, a cellular phone, a video phone, a smart pad, a smart watch, a tablet, a personal computer, a navigation for vehicle, a monitor, a notebook, and/or the like.

The processor 1010 may perform various suitable computing functions. The processor 1010 may be a microprocessor, a central processing unit (CPU), etc. The processor 1010 may be coupled to other suitable components via an address bus, a control bus, a data bus, etc. Furthermore, the processor 1010 may be coupled to an extended bus such as a peripheral component interconnection (PCI) bus.

The memory device 1020 may also store data for operations of the electronic device 1000. For example, the memory device 1020 may include at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device, such as a dynamic random access memory (DRAM) device, a static random access memory (SRAM) device, a mobile DRAM device, and/or the like.

The storage device 1030 may store data for operations of the electronic device 7000. The storage device 1030 may be a solid state drive (SSD) device, a hard disk drive (HDD) device, a CD-ROM device, and/or the like.

The I/O device 1040 may be an input device, such as a keyboard, a keypad, a touchpad, a touch-screen, a mouse, and/or the like, and an output device, such as a printer, a speaker, and/or the like.

The power supply 1050 may provide power for the electronic device 1000.

The display device 1060 may be connected to other elements via the buses or other communication links. According to some example embodiments, the display device 1060 may be in the I/O device 1040. As described above, the display device 1060 may include a display panel including a plurality of pixels, a data driver to provide a data voltage to the display panel, a scan driver to provide a scan signal to the display panel, a global gate driver to provide an emission signal and an initialization signal, and a power supply to provide first and second powers to the display panel.

Each pixel may include a first transistor connected between a data line and a first node and having a gate electrode to receive a scan signal, a driving transistor connected between the first node and a second node and having a gate electrode connected to a third node, a second transistor connected between the second node and the third node and having a gate electrode to receive the scan signal, a third transistor connected between the first power and the first node and having a gate electrode to receive an emission signal, a fourth transistor connected between the first node and the second node in parallel with the driving transistor and having a gate electrode to receive an initialization signal.

Thus, the gate voltage of the driving transistor and the anode voltage of the organic light emitting diode of each of the pixels may be substantially simultaneously initialized to the same voltage. Accordingly, the initialization time for the pixels may be reduced and an initialization deviation of the pixels and an initialization deviation between the gate voltage and the anode voltage may be eliminated. In addition, the transistor for initialization may be an NMOS transistor (e.g., an oxide thin film transistor, NMOS LTPS thin film transistor, etc.) having a high response speed, so that the initialization time may be further shortened.

The present embodiments may be applied to any display device and any system including the display device. For example, the present embodiments may be applied to a HMD, a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The drivers, controllers, and other signal generating and signal processing circuits of the embodiments described herein may be implemented in logic which, for example, may include hardware, software, or both. When implemented at least partially in hardware, the drivers, controllers, and other signal generating and signal processing circuits may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the drivers, controllers, and other signal generating and signal processing circuits may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise indicated. Accordingly, various changes in form and details may be made without departing from the spirit and scope of the embodiments set forth in the claims.

What is claimed is:

1. A display device, comprising:

a display panel including a plurality of pixels; and a display panel driver to drive a plurality of scan lines, a plurality of emission control lines, a plurality of initialization lines, and a plurality of data lines, the display panel driver to provide first power and second power to the display panel, wherein each of the pixels includes:

a first transistor connected between one of the data lines and a first node and having a gate electrode to receive a scan signal;

a driving transistor connected between the first node and a second node and having a gate electrode connected to a third node;

a second transistor connected between the second node and the third node and having a gate electrode to receive the scan signal;

a third transistor connected between a fourth node that receives the first power and the first node and having a gate electrode to receive an emission signal;

a fourth transistor connected between the first node and the second node in parallel with the driving transistor and having a gate electrode to receive an initialization signal;

an organic light emitting diode connected between the second node and the second power: and a storage capacitor connected between the fourth node that receives the first power and the third node, wherein the first power that is applied to the fourth node is a predetermined constant voltage, wherein the display panel driver is to drive the display panel based on a frame which includes:

an initialization period to simultaneously initialize a second node voltage and a third node voltage, a writing period after the initialization period to compensate a threshold voltage of the driving transistor and sequentially write data voltages, and an emission period after the writing period to cause the pixels to simultaneously emit light, wherein the first power that is applied to the fourth node remains unchanged throughout the initialization period, the writing period, and the emission period.

2. The device as claimed in claim 1, wherein:

the driving transistor is a p-channel metal oxide semiconductor transistor, and the fourth transistor is an n-channel metal oxide semiconductor transistor.

3. The device as claimed in claim 2, wherein:

the second power has one of a first voltage level or a second voltage level greater than the first voltage level.

4. The device as claimed in claim 3, wherein:

each of a turn-on level of the scan signal and a turn-on level of the emission signal corresponds to a logic low level, and a turn-on level of the initialization signal corresponds to a logic high level.

5. The device as claimed in claim 3, wherein in the initialization period:

the second power has the first voltage level, the scan signal and the initialization signal have a turn-on level, and the emission signal has the turn-off level.

6. The device as claimed in claim 3, wherein in the writing period:

the second power has the second voltage level, the initialization signal and the emission signal have a turn-off level, and the scan signal has a turn-on level sequentially in order of pixel rows.

7. The device as claimed in claim 3, wherein in the emission period:

the second power has the first voltage level, the emission signal has a turn-on level, and the scan signal and the initialization signal have a turn-off level.

8. The device as claimed in claim 3, wherein:

the first voltage level of the second power is less than the first power, and the second voltage level of the second power is greater than the first power.

9. The device as claimed in claim 2, wherein the display panel driver includes:

a global gate driver to commonly provide the emission signal to the pixels through the emission control lines and to commonly provide the initialization signal to the pixels through the initialization lines.

10. The device as claimed in claim 9, wherein the global gate driver is to:

output the initialization signal having a turn-on level during the initialization period, and output the emission signal having a turn-on level during the emission period.

11. The device as claimed in claim 2, wherein the display panel driver includes:

a scan driver to simultaneously output the scan signal having a turn-on level to the scan lines during the initialization period and to sequentially output the scan signal having the turn-on level to the scan lines in order of pixel rows.

12. The device as claimed in claim 2, further comprising:

a power supply is to provide a sustain voltage to the data lines, wherein the sustain voltage is to be provided to the display panel through the data line in the initialization period and the emission period, and wherein an anode voltage of the organic light emitting diode and a gate voltage of the driving transistor are to be initialized to the sustain voltage in the initialization period.

13. The device as claimed in claim 1, wherein:

the first to fourth transistors and the driving transistor are p-channel metal oxide semiconductor transistors, and the second power has one of a first voltage level and a second voltage level greater than the first voltage level.

14. The device as claimed in claim 13, wherein the display panel driver includes:

a global gate driver to commonly provide the emission signal to the pixels through the emission control lines.

15. The device as claimed in claim 14, wherein the initialization signal corresponds to a next scan signal of a current scan signal corresponding to a next pixel row with respect to a current pixel row.

16. A pixel, comprising:

a first transistor connected between a data line and a first node and having a gate electrode to receive a K-th scan signal, where K is a positive integer;

a driving transistor connected between the first node and a second node and having a gate electrode connected to a third node;

a second transistor connected between the second node and the third node and having a gate electrode to receive the K-th scan signal;

a third transistor connected between a fourth node that receives a first power and the first node and having a gate electrode to receive an emission signal;

a fourth transistor connected between the first node and the second node in parallel with the driving transistor and having a gate electrode to receive an initialization signal;

an organic light emitting diode connected between the second node and a second power; and a storage capacitor connected between the fourth node that receives the first power and the third node, wherein the first power that is applied to the fourth node is a predetermined constant voltage, wherein a display panel driver is to drive the pixel based on a frame which includes:

an initialization period to simultaneously initialize a second node voltage and a third node voltage, a writing period after the initialization period to compensate a threshold voltage of the driving transistor and sequentially write data voltages, and an emission period after the writing period to cause the pixels to simultaneously emit light, wherein the first power that is applied to the fourth node remains unchanged throughout the initialization period, the writing period, and the emission period.

17. The pixel as claimed in claim 16, wherein:

the driving transistor is a p-channel metal oxide semiconductor transistor, and the fourth transistor is an n-channel metal oxide semiconductor transistor.

18. The pixel as claimed in claim 17, wherein the fourth transistor is one of an oxide thin film transistor, a low temperature poly-silicon (LTPS) thin film transistor, or a low temperature polycrystalline oxide (LTPO) thin film transistor.

19. The pixel as claimed in claim 17, wherein:

the second power has one of a first voltage level or a second voltage level greater than the first voltage level.

* * * * *